United States Patent [19]

Tomura et al.

[11] Patent Number: 5,004,364

[45] Date of Patent: Apr. 2, 1991

[54] DEVICE FOR ADVANCING AND RETRACTING WRITING ELEMENT IN WRITING INSTRUMENT

[75] Inventors: Yoshihiro Tomura, Oomiya; Keiji Maruhashi, Isesaki; Nobuyuki Ozawa, Oota, all of Japan

[73] Assignee: Kabushiki Kaisha Pilot, Tokyo, Japan

[21] Appl. No.: 510,080

[22] Filed: Apr. 17, 1990

[30] Foreign Application Priority Data

Jul. 7, 1989 [JP] Japan ..... 1-79599

[51] Int. Cl.[5] ..... B43K 24/08

[52] U.S. Cl. ..... 401/110

[58] Field of Search ..... 401/110, 111, 112, 113, 401/114

[56] References Cited

U.S. PATENT DOCUMENTS

| | | | |
|---|---|---|---|
| 3,137,276 | 6/1964 | Weisser . | |
| 3,179,087 | 4/1965 | Kahn | 401/112 |
| 3,196,839 | 7/1965 | Bertoglio | 401/110 X |
| 3,724,961 | 4/1973 | Levoin | 401/110 |
| 3,810,701 | 5/1974 | Freccero | 401/110 |

FOREIGN PATENT DOCUMENTS

| | | | |
|---|---|---|---|
| 1294263 | 4/1969 | Fed. Rep. of Germany | 401/110 |
| 397466 | 2/1966 | France | 401/113 |

*Primary Examiner*—Richard J. Johnson

*Attorney, Agent, or Firm*—Ladas & Parry

[57] ABSTRACT

A device for advancing and retracting a writing element in a writing instrument, of the type comprising a cylinder, a stationary cam provided on an inner surface of the cylinder, a rotary cam follower disposed inside the stationary cam to be rotatable and slidable axially of the cylinder, the rotary cam follower being in abutting engagement at a front end thereof with the writing element, and a knocking rod disposed in the cylinder and having a front cam portion. When the knocking rod is pushed forward, the knocking rod, the stationary cam and the rotary cam follower cooperate to advance the writing element and maintain the same in an advanced position and to allow the writing element to retract to a retracted position. The knocking rod has projections which are in slidable engagement with slots formed axially through the cylinder. The knocking rod has slots to make it resilient. The knocking rod is inserted into the cylinder through the rear opening of the cylinder until the projections snappingly engage the slots. The capability of inserting the knocking rod from the rear side makes the assembly easy and simple.

4 Claims, 2 Drawing Sheets

DEVICE FOR ADVANCING AND RETRACTING WRITING ELEMENT IN WRITING INSTRUMENT

BACKGROUND OF THE INVENTION

The present invention relates to a writing instrument and, more particularly, to a device for advancing and retracting a writing element in a writing instrument such as a ball-point pen.

There has been well known to those skilled in the art a device for advancing and retracting a writing element of the type in which a forward cam portion of a knocking rod cooperates with a rotary cam follower which coacts with a stationary cam formed on the inner wall surface of a sheath body. When the knocking rod is knocked or pushed forward by the thumb, the rotary cam follower engages with or disengages from inclined cam surfaces of the stationary cam so that the writing element is advanced out of or retracted into the writing instrument body.

In the case of the writing-element advancing and retracting device of the type described above, the writing element is always resiliently biased against the rotary cam follower, so that when the writing element is allowed to retract into the body with the rotary cam follower disengaged from the stationary cam, the knocking rod will be forced toward a rear opening of the body due to the resilient biasing force. Therefore, the knocking rod will be slipped rearward out of the rear opening if a suitable countermeasure is not provided to prevent this. In order to eliminate this problem, there have been proposed various structures.

For instance, in a conventional advancing and retracting device, a radially inwardly projecting engaging stop is formed on the inner wall of the body so that when the writing element is retracted, an engaging portion of the knocking rod is brought into abutting engagement with the engagement stop, thereby preventing the knocking element from slipping out of the writing instrument body. Furthermore, in another conventional advancing and retracting device, an inward flange is formed in the vicinity of the rear opening of the writing instrument body in opposing cooperative relation with projections extending radially outwardly from the outer surface of the knocking rod, whereby the knocking rod is prevented from slipping rearward out of the body.

In both cases, it is impossible in the assembling operation to insert the knocking rod into the body through its rear opening since the knocking rod has a diameter greater than the inner diameter of the inwardly directed engaging stop or flange of the body. Therefore, the knocking rod must be inserted into the body through the front opening.

The rear end portion of the knocking rod, or knocking head exposed out of the rear opening of the body is a component part to which is imparted the knocking or pushing force by the thumb of the user. It is therefore desirable to make the diameter of the knocking head as great as possible from the viewpoint of good outer appearance and smooth knocking operation. In the case of the writing element advancing and retracting device described above, the knocking head is a member separate from the knocking rod and fitted to the rear end of the knocking rod in an assembling step carried out after a step of inserting the knocking rod into the body.

Therefore, the knocking head is naturally greater in diameter than the knocking rod.

The above fact raises various problems that the number of component parts of the writing instrument increases and special jigs must be used when the knocking head is attached or fitted to the rear end of the knocking rod so that productivity is low and the fabrication cost is high.

Moreover, due to the fact that the knocking head must be inserted into the body through the front opening thereof, the writing instrument body must be maintained upright with the rear opening directed upwardly, until the knocking rod has been fitted and assembled in position within the body, in order to prevent the knocking rod from slipping out of the body through the rear opening.

SUMMARY OF THE INVENTION

The main purpose of the present invention is to eliminate the above stated problems encountered in the conventional writing element advancing and retracting device.

According to the present invention, there is provided a device for advancing and retracting a writing element in a writing instrument, comprising a cylinder, a knocking rod disposed in the cylinder and having a front end and a rear end exposed from a rear opening of the cylinder for knocking operation, and cam means provided in the cylinder to be acted upon by the front end of the knocking rod upon the knocking operation so as to advance the writing element and maintain the same in an advanced position and to allow the writing element to retract to a retracted position: said device comprising projection means formed on the outer surface of the knocking rod so as to project radially outwardly of the rod, said projection means being resiliently displaceable radially inward upon being forced radially inward, and guide means provided in the cylinder to engage and guide said projection means so as to allow the projection means and hence the knocking rod to move axially of the cylinder, said guide means having at a rear end thereof stop means for abutting said projection means to prevent the knocking rod from slipping out of the rear opening of the cylinder.

According to the present invention, therefore, the knocking rod can be inserted into the cylinder or body through the rear opening regardless of the diameter of the cylinder. As a result, it is not needed to prepare an independent knocking head which is attached to the rear end of the knocking rod in the conventional rod, and the rear end portion of the knocking rod can be made to have a desired diameter.

Preferred embodiments of the present invention will now be described in detail with reference to the accompanying drawings.

DESCRIPTION OF THE PREFERRED EMBODIMENTS

Figure 1:
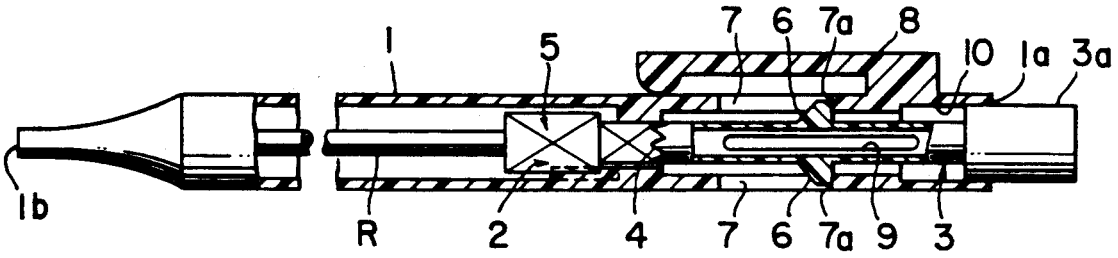
FIG. 1 is a longitudinal sectional view illustrating a preferred embodiment of the device for advancing and retracting a writing element of a writing instrument, in accordance with the present invention.
Figure 2A:
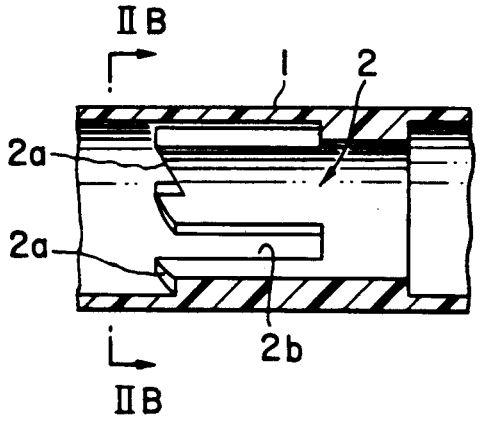
FIG. 2A is a sectional view, on an enlarged scale, of a portion of a writing instrument cylinder shown in FIG. 1.
Figure 2B:
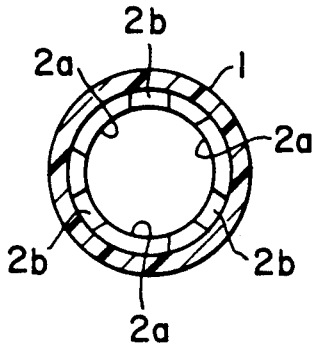
FIG. 2B is a sectional view taken along the line IIB—IIB of FIG. 2A.

Referring to FIG. 1, there is shown a writing instrument in the form of a ball-point pen, which has a cylinder 1 used as the barrel of the writing instrument. The cylinder 1 has a front opening 1*b* at the front end thereof and a rear opening la at the rear end thereof. The cylinder 1 has a clip 8 on a rear part thereof. Formed at the inner wall surface of the cylinder 1 is a known cylindrical stationary cam 2 comprising sloping cam surfaces 2*a* and axial grooves 2*b* formed between adjoining cam surfaces 2*a*, as shown in FIGS. 2A and 2B.

Figure 2C:
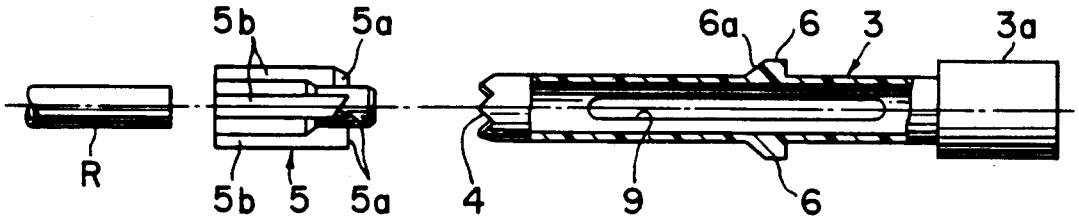
FIG. 2C is an exploded view showing a writing element, a rotary cam follower and a knocking rod.

A known rotary cam follower 5 is disposed within the cylinder 1 and operatively associated with the stationary cam 2. As shown in FIG. 2C, the rotary cam follower 5 has therearound axially extending ribs 5*b* each having a sloping surface 5*a* at the rear end thereof. The ribs 5*b* are in sliding engagement with the respective grooves 2*b* of the stationary cam 5 in a manner well known in the art.

The sloping surfaces 5*a* of the rotary cam follower 5 coact with a known cam portion 4 formed on the front end of a knocking rod 3 shown in FIGS. 1 and 2C. The knocking rod 3 has an enlarged knocking head 3*a* on the rear end thereof. The knocking head 3*a* is exposed from the rear opening 1*a*.

A writing element R having a writing end is enclosed in the cylinder 1. The writing end is, for example, a ball-point end not shown. The rear end of the writing element R is in abutting engagement with the rotary cam follower 5 as is known in the art.

When the knocking rod 3 is knocked forwardly at its knocking head 3*a*, the cam portion 4 of the knocking rod 3 engages the sloping surfaces 5*a* of the rotary cam follower 5 and moves the cam follower forward. As the ribs 5*b* slide along the grooves 2*b* forward and move out of the grooves, the rotary cam follower 5 is rotated due to the engagement with the cam portion 4, and the sloping surfaces 5*a* of the rotary cam follower 5 ride on and engage the cam surfaces 2*a* of the stationary cam 2. When the rotary cam follower 5 engages the cam surfaces 2*a*, the writing element R in contact with the rotary cam 5 is maintained in its advanced state, so that the writing end projects from the front opening 1*b* and takes a writing position.

When the knocking head 3*a* is knocked with the writing element R in the writing position, the rotary cam follower 5 is once moved forward off the cam surfaces 2*a* of the stationary cam 2, so that the rotary cam follower 5 is rotated due to its contact with the cam portion 4. Thereafter, when the knocking head 3*a* is released, the rotary cam follower 5 is retracted along the grooves 2*b* due to the force of a known spring (not shown) urging the writing element R rearwardly. As a result, the knocking rod 3 is also retracted.

The above stated features of the writing instrument are known in the art.

According to a characteristic feature of this invention, the knocking rod 3 is formed with a pair of radially outwardly extending engaging projections 6 on an axially intermediate part thereof. The knocking rod 3 is hollow and has axially extending slots 9 which are formed through the cylindrical wall of the rod at positions between the two projections 6. The knocking rod 3 is made of, for example, a synthetic resin having a small degree of elasticity, so that the slots 9 make it possible to elastically deform the rod 3 radially inwardly.

As indicated in FIG. 1, the cylinder has a pair of diametrically opposite guide slots 7 formed axially through the cylindrical wall of the cylinder. The slots 7 have stop ends 7*a* at the rear thereof. The projections 6 of the knocking rod 3 are in guided sliding engagement with the slots 7, respectively. The stop ends 7*a* serve to prevent the projections 6 and therefore the knocking rod 3 from slipping rearward out of the rear opening 1*a*. The internal hole of the cylinder 1 is enlarged at the rear end to form an enlarged cylindrical inner recess 10 in which the enlarged knocking head 3*a* is slidably fitted.

In this embodiment, two engaging projections 6 and two guide slots 7 are provided, but it is to be understood that more engaging projections 6 and guide slots 7 may be provided.

It is preferable that two or more engaging projections 6 and guide slots 7 are provided so that a stable action of the knocking rod 3 can be obtained. It will be apparent that the number of the guide slots 7 is equal to that of the engaging projections 6.

The engaging projections 6 may be in the form of a peripheral flange extending around the entire outer surface of the knocking rod 3. In this case, it is necessary to form a cylindrical recess in the inner wall surface of the cylinder 1. In this modification, a measure must be taken to limit rotation of the knocking rod 3 within the cylinder 1, depending upon the structural relationship between the cam portion 4 of the knocking rod 3 and the stationary cam 2, but this modified construction has an advantage in that a more stable action of the knocking rod 3 can be obtained within the cylinder 1.

As described previously, the engaging projections 6 can be displaced radially inwardly due to the elastic formation of the knocking rod 3. This fact is advantageous in assembling the knocking rod 3 in position to maintain a state in which the engaging projections 6 are engaged with the stop ends 7*a* of the slots 7, that is, a state in which the writing element R is retracted to its rearmost position. A further advantage is that even if the knocking rod 3 is aged, its stability in action can be ensured. A yet further advantage is that in the case of the insertion of the knocking rod 3 into the cylinder 1, it is not needed to take into consideration the material of the cylinder 1 in relation to the knocking rod 3.

Figure 3:
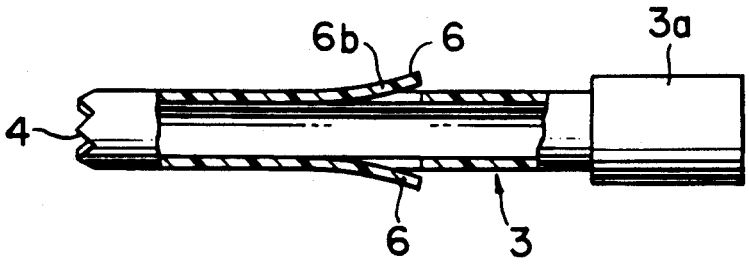
FIG. 3 is a sectional view showing a modified knocking rod.

Means for enabling the engaging projections 6 to be displaced radially inwardly may be suitably selected. For instance, as shown in FIG. 3, the engaging projections 6 may be formed as resilient arms each formed by cutting a portion of the wall of the knocking rod 3 so as to cause the cut portion to extend obliquely outward.

When the knocking rod 3 is inserted into the cylinder 1, the front cam portion 4 is first inserted through the rear opening 1*a* into the cylinder 1 and the knocking rod 3 is pushed forward with the projections 6 resiliently displaced radially inward by contact with the inner wall of the cylinder 1. In the case of the knocking rod 3 shown in FIG. 2C, the slots 9 facilitate resilient deformation of the rod 3 radially inward to allow the projections 6 to be displaced radially inward. The front sloping surfaces 6*a* of the projection 6 facilitate gradual inward displacement of the projections 6 when the projections are to be inserted into the hollow interior of the cylinder. In the case of the knocking rod 3 shown in FIG. 3, the sloping outer surfaces 6*b* serve the same purpose.

As the knocking rod 3 is moved forward into the cylinder 1 to a position in which the projections 6 reach the stop ends 7*a* of the slots 7, the projections 6 are allowed to resiliently expand into the slots 7 so that the knocking rod 3 becomes movable axially under the guidance of the slots 7 with the strokes of the rod 3 limited by the length of the slots 7. Thus, it is possible to fit the knocking rod 3 in position within the cylinder 1. The knocking head 3*a* may be provided integrally with the rear end of the knocking rod 3. The capability of inserting the knocking rod 3 through the rear opening 1*a* makes the assemblying process much simple.

Figure 4:
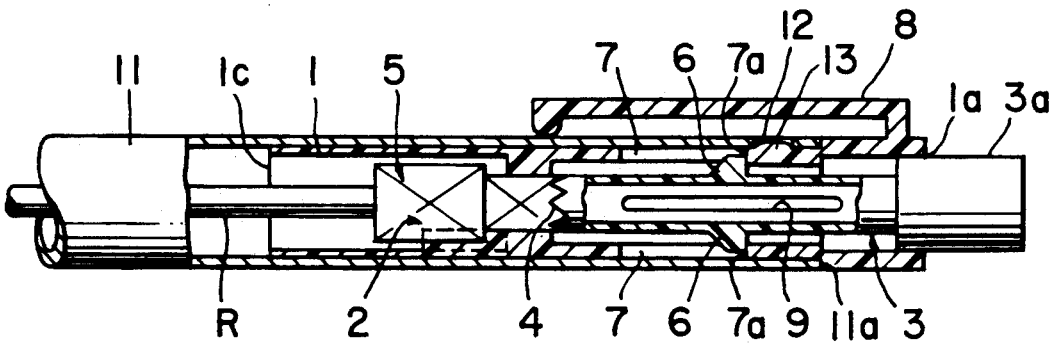
FIG. 4 is a view similar to FIG. 1 but showing a modification of the embodiment of FIG. 1.

In a modification shown in FIG. 4, the cylinder 1 does not form a part of the holder barrel of the writing instrument. The cylinder 1 terminates at a forward end 1*c* and a separate barrel 11 is fitted over the cylinder 1. The rear end of the barrel 11 is shown at 11*a*. A hole 12 is formed through the rear part of the barrel 11 and a protrusion 13 on the outer surface of the cylinder 1 is fitted in the hole 12 to securely hold the barrel 11 on the cylinder 1.

It will be understood from the foregoing that the present invention provides a device for advancing and retracting a writing element in which the assemblying operation of the knocking rod into the cylinder is simplified and the number of the component parts is reduced.

What is claimed is:

1. In a device for advancing and retracting a writing element in a writing instrument, comprising a cylinder having a front opening through which the writing element advances and retracts and a rear opening, a knocking rod disposed in the cylinder and having a front end and a rear end exposed from the rear opening of the cylinder for knocking operation, said front end being formed as a cam portion, stationary cam means provided on an inner surface of the cylinder and having front sloping cam surfaces and guide grooves, said front sloping cam surfaces and guide grooves being arranged alternately in the circumferential direction of said inner surface of the cylinder in such a manner that the guide grooves extend from the cam surfaces axially of the cylinder toward said rear opening, and a rotary cam follower provided in the cylinder and engaging said guide grooves for guided movement axially of the cylinder, said writing element being resiliently urged rearwardly of the cylinder against said cam follower, said rotary cam follower being disposed in front of said knocking rod so as to be acted upon by said cam portion when the knocking rod is pushed, said cam portion being shaped to impart a rotary force to the rotary cam follower while acting on the cam follower whereby when the knocking rod is pushed, until the cam follower is disengaged from the guide grooves, and is then released, the rotary cam follower is rotated to abut on said front sloping cam surfaces, thereby to maintain the writing element in an advanced position, and whereby when the knocking rod is pushed and released next time, the rotary cam follower is moved off the front sloping cam surfaces and is then engaged under rotary force into the guide grooves to be moved rearward along the grooves to allow the writing element to move back to a retracted position:

the improvement comprising:

engaging projections integrally formed on the outer surface of the knocking rod so as to project radially outwardly of the rod, said projections being arranged in circumferentially spaced apart disposition, said rod having slots extending axially thereof between adjoining engaging projections thereby to make the engaging projections resiliently displaceable radially inward upon being forced radially inward; and guide means in the form of slots provided in the cylinder to extend axially thereof and engaging said projections to guide the projections and hence the knocking rod therealong, said guide means having at a rear end thereof stop means for abutting said projections to prevent the knocking rod from slipping out of the rear opening of the cylinder.

2. The device according to claim 1, wherein each of said projections has a sloping front surface.

3. The device according to claim 1, wherein the knocking rod has an integral enlarged knocking head at the rear end thereof.

4. The device according to claim 1, wherein said cylinder has a separable cylindrical portion which has said stationary cam means and said guide means.

* * * * *